US005822892A

United States Patent [19]

Ohbatake et al.

[11] Patent Number: 5,822,892

[45] Date of Patent: Oct. 20, 1998

[54] WORKING VEHICLE

[75] Inventors: Youjirou Ohbatake, Uji; Hidetoshi Sasaki, Kawasaki, both of Japan

[73] Assignee: Komatsu Ltd., Tokyo, Japan

[21] Appl. No.: 836,527

[22] PCT Filed: Nov. 6, 1995

[86] PCT No.: PCT/JP95/02252

§ 371 Date: May 5, 1997

§ 102(e) Date: May 5, 1997

[87] PCT Pub. No.: WO96/14476

PCT Pub. Date: May 17, 1996

[30] Foreign Application Priority Data

Nov. 8, 1994 [JP] Japan ..... 6-300376

[51] Int. Cl.[6] ..... E02F 3/38

[52] U.S. Cl. ..... 37/397; 414/694; 414/685

[58] Field of Search ..... 37/379, 397, 403; 414/685, 687, 694, 722, 729, 699, 680

[56] References Cited

U.S. PATENT DOCUMENTS 5,375,348 12/1994 Kishi ..... 37/461 X
5,413,454 5/1995 Movesian ..... 414/729
5,584,643 12/1996 Nishimura et al. ..... 414/694
5,611,657 3/1997 Peterson ..... 414/722

FOREIGN PATENT DOCUMENTS 62-190748 12/1987 Japan .
2-8419 1/1990 Japan .
6-136779 5/1994 Japan .

*Primary Examiner*—Michael J. Carone
*Assistant Examiner*—Robert Pezzuto
*Attorney, Agent, or Firm*—Sidley & Austin

[57] ABSTRACT

The present invention is a working vehicle having high visibility and transportability and is capable of providing a large excavation force over a wide range. To this end, a working unit (30) is provided with a boom (31), which is divided into a first boom (31*a*) and a second boom (31*b*), and an arm (32), which is fixed to a front end portion of the second boom (31*b*). The first boom (31*a*) is free to be swung by a first boom hydraulic cylinder (36) and the second boom (31*b*) is free to be swung by a second boom hydraulic cylinder (37). One end portion of a first arm link (33*a*) is attached to a front end portion of the second boom (31*b*), and one end portion of a second arm link (33*b*) is attached to a rear end portion of the arm (32), with one end portion of an arm hydraulic cylinder (38) and the other end portions of the first arm link (33*a*) and the second arm link (33*b*) being connected together.

19 Claims, 5 Drawing Sheets

WORKING VEHICLE

TECHNICAL FIELD

The present invention relates to a working vehicle, and particularly to a working vehicle having a working unit such as a bucket or the like in front of the operator's seat.

BACKGROUND ART

An example of a previously proposed working vehicle having a working unit, such as a bucket, etc., forward of an operator's seat is disclosed in Japanese Patent Application Laid-open No. 6-136779. A construction machine 100, in the form of a working vehicle, has a first boom 131*a* attached to a vehicle body frame 121, a second boom 131*b* attached to the first boom 131*a*, and an arm 132 attached to the second boom 131*b*, so as to respectively be free to swing. A working unit 130, having a bucket 133 or the like, is attached to the arm 132. In a traveling posture, the bucket 133 is stably placed on a bracket 115, fixed on the front portion of a base frame 111, and is stably stored by hooking the front end portion of the bucket 133 with a hooking device 116.

The construction machine 100 is provided with a first boom hydraulic cylinder 135 which is attached to the vehicle body frame 121 and to the second boom 131*b* for swinging the second boom 131*b*; a second boom hydraulic cylinder 136 which is attached to the second boom 131*b* and to the first boom 131*a* for swinging the second boom 131*b*; and an arm hydraulic cylinder 137 which is attached to the second boom 131*b* and to the arm 132 for swinging the arm 132. As for these booms, hydraulic cylinders, etc., the vehicle body frame 121 and the first boom 131*a* are connected by a pivot pin 123, the first boom 131*a* and the second boom 131*b* are connected by a pivot pin 141, the vehicle body frame 121 and the first boom hydraulic cylinder 135 are connected by a pivot pin 124, and the second boom 131*b* and the first boom hydraulic cylinder 135 are connected by a pivot pin 143. In the storage posture illustrated in FIG. 4, relative to a line connecting the pivot pin 123 and the pivot pin 141, the pivot pin 124 is positioned near one end portion of the line and the pivot pin 143 is positioned near the other end portion of the line.

However, in the traveling posture (FIG. 4) with the working unit 130 being stored, the above-described construction machine 100 has an increased amount of front overhang 112 and a greater rotation radius. For example, when an operator's cab 160 is attached on the left side while the working unit 130 is attached on the right side, a height 113 of the storage posture of the arm 132 and the arm hydraulic cylinder 137 becomes great; therefore, there is a disadvantage of low visibility in the direction the lower part of the right front side.

As the art for improving the above-described visibility, a construction machine 110 illustrated in FIG. 5 is known. The construction machine 110 has a higher visibility of the side portion in a traveling posture with the working unit 130 being stored as compared to the construction machine 100 in a stored posture. However, since a height of stored posture 114 of the working unit 130 is high, the position of the center of gravity of the construction machine 110 is high, and a disadvantage exists with regard to the stability at the time of traveling at high speed.

Further, as the number of traveling vehicles on roads is increasing recently, the improvement of the transportability (traveling ability) of working vehicles on ordinary roads is strongly demanded. Especially, for working vehicles which frequently have to go to different working places, the ability of traveling on an ordinary road as well as increased traveling speed at the time of transportation is demanded. In this case, stability at the time of traveling at high speed, cornering ability, reduction of the entire length, visibility, agility, etc., are demanded.

SUMMARY OF THE INVENTION

The present invention is made in order to eliminate the above-described disadvantages in the conventional art, and its object is to provide a working vehicle having high visibility and transportability, and a large excavating force over a wide range, with a working unit which can be smoothly operated.

The working vehicle relating to the present invention is a working vehicle provided with an upper rotary body on a base carrier, with a working unit, comprising a boom, an arm, and a bucket, and an operator's cab which are respectively attached to said upper rotary body;

characterized by the above-described working unit being a working unit which is provided with a boom divided into a first boom, attached to the vehicle body frame by the medium of a point pin,and a second boom, attached to said first boom by the medium of a second pivot pin; an arm, attached to a front end portion of the second boom by the medium of a seventh pivot pin; and a bucket, attached to a front end portion of the arm;

the first boom being free to be swung by a first boom hydraulic cylinder, which is attached by a sixth pivot pin to the second boom and by a fifth pivot pin to the vehicle body frame; and the second boom being free to be swung by a second boom hydraulic cylinder, which is attached by a third pivot pin to the first boom and by a fourth pivot pin to of a rear end portion of the second boom, and characterized by one end portion of a first arm link being attached to the second boom by the medium of a tenth pivot pin attached in the vicinity of the seventh pivot pin;

one end portion of a second arm link being attached to the rear end portion of the arm by the medium of an eighth pivot pin, and one end portion of an arm hydraulic cylinder, having the other end portion attached to the rear portion of the second boom, and each of the other end portions of the first arm link and the second arm link being connected together by the medium of a ninth pivot pin.

The length between the centers of the ninth pivot pin and the tenth pivot pin can be greater than the length between the centers of the eighth pivot pin and the seventh pivot pin. Further, it is desirable that the second boom storage section for storing the second boom is provided inside the first boom, and that at the time of traveling, the divided boom has the second boom stored in the second boom storage section. Furthermore, it is desirable that the arm is parallel to a top surface of a base frame of the base carrier with the arm hydraulic cylinder being contracted, and that the posture of the working unit at the time of traveling is a stored posture in which the divided boom in a stored condition and the arm with the arm hydraulic cylinder being contracted make a substantially V-shaped form.

According to the above-described configuration, in which the divided boom is used, the second boom is rotated, with the second pivot pin as its fulcrum, by contracting the rod of the second boom hydraulic cylinder at the time of the operation, from the storage posture to the working posture. By extending the first boom hydraulic cylinder simultaneously with this contraction, the first boom is rotated in a counterclockwise direction with the first pivot pin as its fulcrum. In the storage posture, when the line connecting the centers of the first and second pivot pins is a reference, the line connecting the centers of the first and the sixth pivot pins has an angle in a counterclockwise direction; therefore, a derricking operation can be carried out smoothly. When the working unit is shifted from the storage posture to the working posture, or from the working posture to the storage posture, the divided boom is smoothly operated over an extremely wide range by supplying actuator oil to the second boom hydraulic cylinder and the first boom hydraulic cylinder.

When the first and the second arm links are operated by derricking the arm hydraulic cylinder, a rotation angle of the arm, greater than in the conventional art, can be obtained relative to the stroke of the arm hydraulic cylinder since the length between the centers of the ninth and tenth pivot pins is made relatively greater. In addition, since the radius of the rotation moment is greater than in the conventional art, the excavating force at the edge of the front end of the bucket is increased.

Further, when the second boom storage section is provided inside the first boom, the divided boom is in a compact stored posture since the second boom is stored by extending the second boom hydraulic cylinder. Accordingly, since an operator in an operator's cab can have excellent visibility with the stored posture at the time of traveling, safety can be secured. Further, the arm at the time of being stored becomes almost parallel to the top surface of the base frame, and the arm and the divided boom are made to be in a substantially V-shaped form. Thereby, excellent visibility can be obtained, while the center of gravity of the working unit is at a lower position, so that stability can be secured at the time of traveling at high speed.

BEST MODE FOR CARRYING OUT THE INVENTION

A preferable embodiment of a working vehicle relating to the present invention will be particularly described with reference to the attached drawings.

Figure 1:
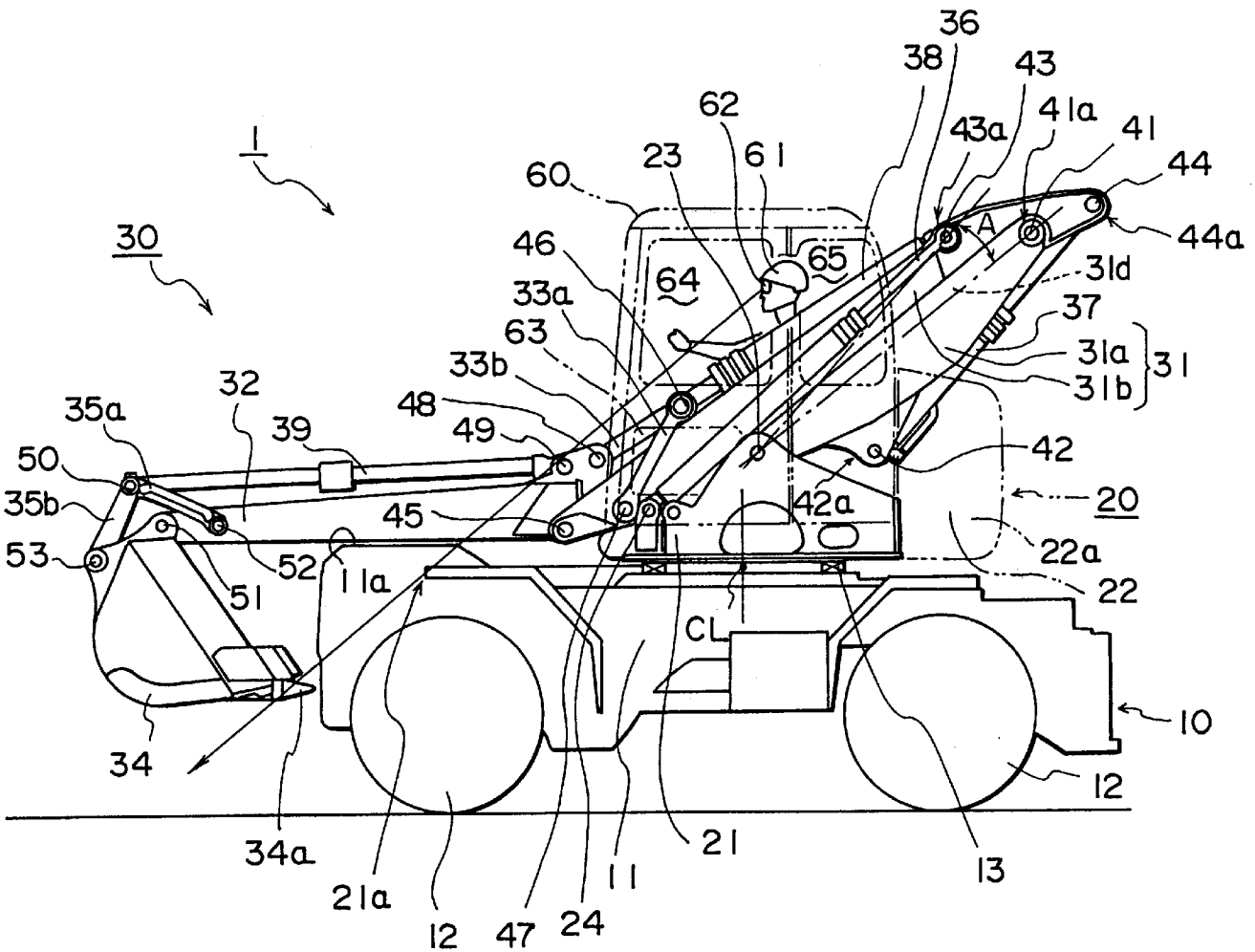
FIG. 1 is a side view of a working vehicle in a stored posture relating to an embodiment of the present invention.
Figure 2:
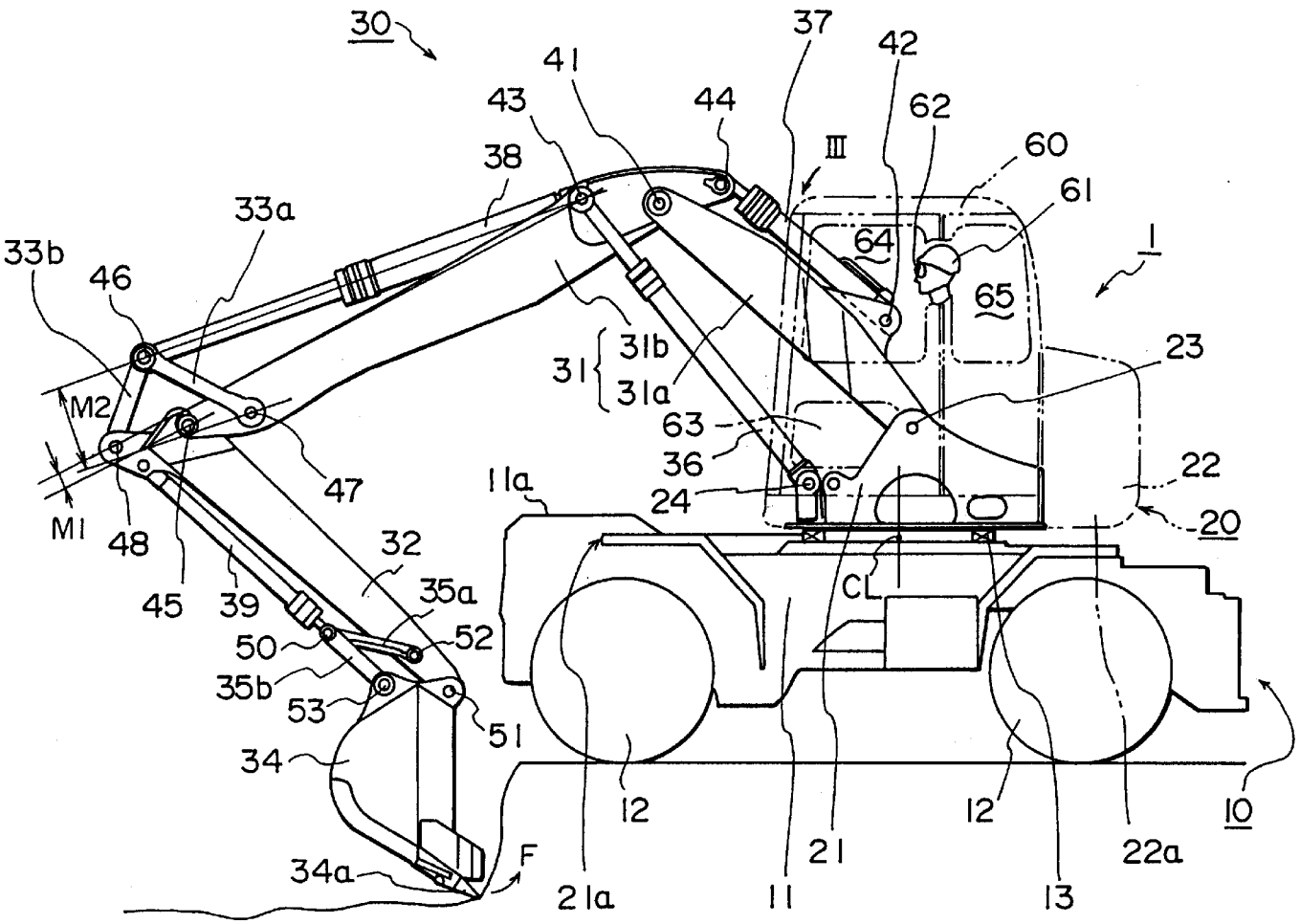
FIG. 2 is a side view of a working vehicle in a working condition relating to the embodiment.

In FIGS. 1 and 2, a working vehicle 1 includes a base carrier 10 and an upper rotary body 20, which is placed on the base carrier 10 so as to be free to rotate with a point CL close to the center of the base carrier 10 as its center of rotation. The working vehicle 1 also includes a working unit 30, which is placed on a vehicle body frame 21 on the upper rotary body 20 and which is free to derrick relative to the upper rotary body 20, and an operator's cab 60, for an operator 61 to sit in to operate the working unit 30.

The base carrier 10 includes wheels 12, which are rotated by a traveling hydraulic motor (not illustrated) mounted on a base frame 11 or the like and which move the working vehicle 1, and a rotation bearing 13, which is positioned on the base frame 11 for supporting the upper rotary body 20. Incidentally, the wheels 12 can be an endless crawler belt.

The upper rotary body 20 comprises of the vehicle body frame 21, which is supported by the rotation bearing 13, and a rotary body cover 22, which is attached to the vehicle body frame 21 and includes a counterweight 22*a*. The upper rotary body 20 is installed so as to be free to rotate in a horizontal direction relative to the center of rotation CL located almost at the center of the base frame 11 both in a width direction and in a fore-and-aft direction; and the upper rotary body 20 is rotated by a hydraulic motor for rotation (not illustrated), which is actuated by an operation of the operator 61 in the operator's cab 60.

A first pivot pin 23, supporting the working unit 30 so as to be free to derrick, is attached to the vehicle body frame 21. A fifth pivot pin 24, attached to the vehicle body frame 21, supports one end portion of a first boom hydraulic cylinder 36; and by the extension and contraction of the first boom hydraulic cylinder 36, a second boom 31*b* is operated so as to be free to derrick. The first pivot pin 23 and the fifth pivot pin 24 can be pivot pins fixedly attached to the vehicle frame 21. Further, the hydraulic motor for rotating the working vehicle 1, a change-over valve (not illustrated) for each of the above-described hydraulic cylinders for derricking the working unit 30, etc., are positioned inside the rotary body cover 22.

The working unit 30 includes a boom 31, comprising of a first boom 31*a* and a second boom 31*b* which are capable of pivoting; an arm 32; a bucket 34; the first boom hydraulic cylinder 36; a second boom hydraulic cylinder 37; an arm hydraulic cylinder 38; and a bucket hydraulic cylinder 39. The working unit 30 also includes first and second arm links 33*a* and 33*b*, which are serially connected between the arm 32 and the second boom 31*b*; bucket links 35*a* and 35*b*, which are serially connected between the arm 32 and the bucket 34; and a number of pivot pins, described below, connecting each member, hydraulic cylinder, etc.

The above-described pivot pins are configured in such a way as to include a connecting pivot pin and a bushing. For example, in the case of a second pivot pin 41 connecting the first boom 31*a* and the second boom 31*b* as well as supporting the second boom 31*b*, a connecting pin is fixed to the first boom 31*a* and a bushing is inserted into a hole in the second boom 31*b*. Or, the pin can be are configured in a reverse way; specifically, by including the connecting pin fixed to the second boom 31*b* and the bushing inserted into the hole provided in the first boom 31*a*. A preferable configuration is the one in which a connecting portion of one member has a crotch and in which a connecting portion of the other member is inserted into the crotch and is linked by the pivot pin, but other ordinary configurations of the connecting portions are suitable, without being limited to the above-described configuration.

The first boom 31*a* is attached to the vehicle body frame 21 via the first pivot pin 23 so as to be free to swing, and has the second pivot pin 41, supporting the second boom 31*b*, and a third pivot pin 42, supporting the second boom hydraulic cylinder 37.

The detailed form of the first boom 31*a* will be explained with reference to FIG. 3. The first boom 31*a* has side panels 31L and 31R, which are box-shaped members which are connected and fastened together by connectors 31C. The end portions of both of the side panels 31L and 31R have a forked connecting portion fulcrum 23*a*, to be connected to the first pivot pin 23 and a forked connecting portion fulcrum 41*a*, to be connected to the second pivot pin 41. A forked connecting portion fulcrum 42*a*, which is provided on the first pivot pin 23 side of a connector 31C, holds the bottom side of the second boom hydraulic cylinder 37 via the third pivot pin 42 and allows the housing side thereof to be free to rotate. On the other hand, the rod side of the second boom hydraulic cylinder 37 is connected to a forked connecting portion fulcrum 44*a* of the second boom 31*b* via a fourth pivot pin 44 so as to be free to rotate. The forked connecting portion fulcrum 41*a* holds one end of the second boom 31*b* via the second pivot pin 41 and allows the second boom 31*b* to be free to swing.

Figure 3:
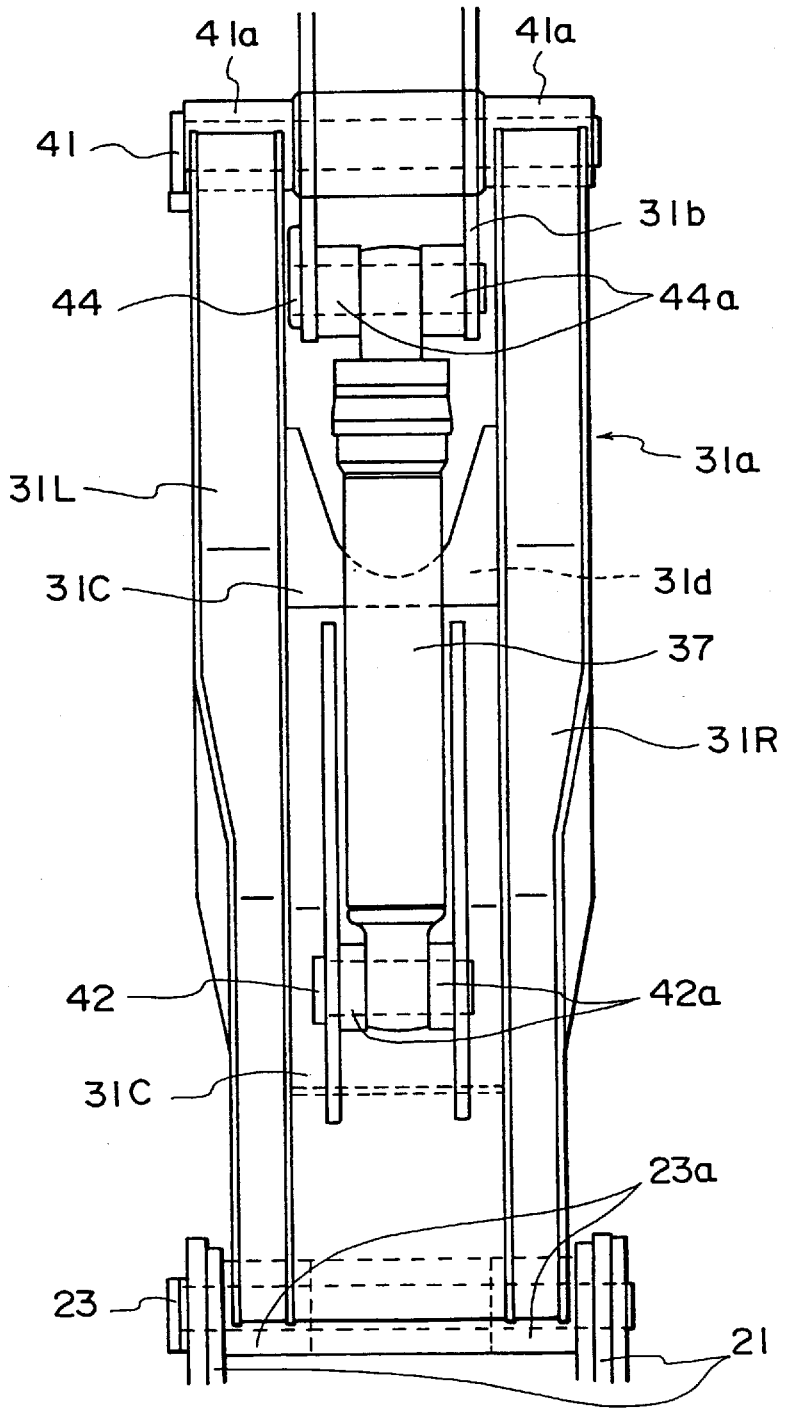
FIG. 3 is a view, seen from the direction of an arrow III in FIG. 2, for explaining the configuration in which a second boom and a second boom hydraulic cylinder are stored in a first boom.

In the above-described configuration in FIG. 3, by extending the rod of the second boom hydraulic cylinder 37, the second boom 31*b* rotates with the second pivot pin 41 as the axis of rotation, and is inserted between the side panels 31L and 31R of the first boom 31*a* so as to be stored in a second boom storage section 31*d* in such a way as to face the second boom hydraulic cylinder 37.

Returning to FIG. 1, the second boom 31*b* is provided at one end portion with a sixth pivot pin 43, attaching one end of the arm cylinder 38. The first boom hydraulic cylinder 36 is connected between sixth pivot pin 43 and the vehicle frame 21. Also at that one end portion, the second boom 31*b* is provided with the fourth pivot pin 44, for attaching one end of the second boom hydraulic cylinder 37, the other end of which is connected to the first boom 31*a*. On the other hand, on the other end portion, the second boom 31*b* is provided with a seventh pivot pin 45, for supporting the arm 32, and a tenth pivot pin 47, for supporting the first arm link 33*a*.

The second boom 31*b* is provided with forked fulcrums 43*a* and 44*a* so as to insert and hold the rod portion of the second boom hydraulic cylinder 37 and the housing portion of the arm hydraulic cylinder 38 therein. Thereby, the arm hydraulic cylinder 38 can be stored in the second boom 31*b* when its rod is contracted.

The arm 32 is attached at the second boom 31*b* through the seventh pivot pin 45 so as to be free to swing. At the end portion of the arm 32 adjacent to the seventh pivot pin 45, an eighth pivot pin 48, attaching the second arm link 33*b*, and a pivot pin 49, attaching the bucket hydraulic cylinder 39, are provided. At the front end portion of the arm 32, a bucket supporting pivot pin 51, allowing the bucket 34 to be free to swing, and a bucket link supporting pivot pin 52, supporting the bucket link 35*a* are attached.

The bucket 34 is connected to the bucket link 35*b* through the bucket link supporting pivot pin 53. 34*a* shows the front end of the bucket. Bucket link 35*a* is attached to the arm 32 through the bucket link supporting pivot pin 52 so as to be free to swing, and is connected to the bucket link 35*b* through a pivot pin 50. To the pivot pin 50, the bucket hydraulic cylinder 39 is also connected.

The first boom hydraulic cylinder 36 is actually two hydraulic cylinders connected in such a way as to hold the second boom 31*b* between. Each housing portion of the two first boom cylinders 36 is attached via the fifth pivot pin 24 to the vehicle body frame 21, and each rod portion is attached via the sixth pivot pin 43 to the second boom 31*b*. The second boom hydraulic cylinder 37 has its housing portion attached via the third pivot pin 42 to the first boom 31*a*, and its rod portion attached via the fourth pivot pin 44 to the second boom 31*b*. As for the arm hydraulic cylinder 38, its housing portion is attached via the sixth pivot pin 43 to the second boom 31*b*, and its rod portion is attached to the arm links 33*a* and 33*b* via the ninth pivot pin 46. The bucket hydraulic cylinder 39 has its housing portion attached via the pivot pin 49 to the arm 32, and its rod portion attached to the bucket links 35*a* and 35*b* via pivot pin 50. The attachment of each hydraulic cylinder in the embodiment can be conducted by reversing the housing portion and the rod portion as necessary.

The operation by the above-described configuration will be explained. A line connecting the centers of two pins is expressed as a line segment; for example, the line connecting the center of the first pivot pin 23 and the center of the second pivot pin 41 is expressed as line segment 23/24.

In FIG. 1 which shows a storage posture of the working unit 30, when the first pivot pin 23 is the center of the base end portion of the hands of a clock, the first boom 31*a* is at the position of two o'clock, and the first boom 31*a* is parallel to the second boom 31*b*. Then, when the center of the first pivot pin 23 is a reference point and the line segment 23/41 is a reference line, and when an angle in a counterclockwise direction is a positive number, and an angle in a clockwise direction is a negative number, an angle A made by the line segment 23/41 and a line segment 23/43 is a positive number. Accordingly, when derricking the working unit 30 from the storage posture, a smooth derricking operation can be attained.

In the storage position with the arm hydraulic cylinder 38 being contracted at the time of transport, the first boom 31*a* is inclined rearwardly of pivot pin 23, the second boom 31*b* is stored in the inside of the first boom 31*a* with the second pivot pin 41 as the fulcrum, and with the arm 32 extending generally horizontally forwardly form the front end of the second boom 31*b* . At the same time, the arm hydraulic cylinder 38 is stored in the inside of the second boom 31*b* with the sixth pivot pin 43 as the fulcrum. Accordingly, the second boom 31*b* and the arm hydraulic cylinder 38 are compactly stored. In this position, the bottom surface of the arm 32 is almost parallel to the top surface 11*a* of the base frame 11. By placing the arm 32 directly on the top surface 11*a*, or on a stabilizing member mounted on the top surface 11*a*, the working unit 30 is stabilized at the time of traveling. In addition, since the center of gravity of the working unit 30 is at a low position, excellent stability can be obtained.

Figure 4:
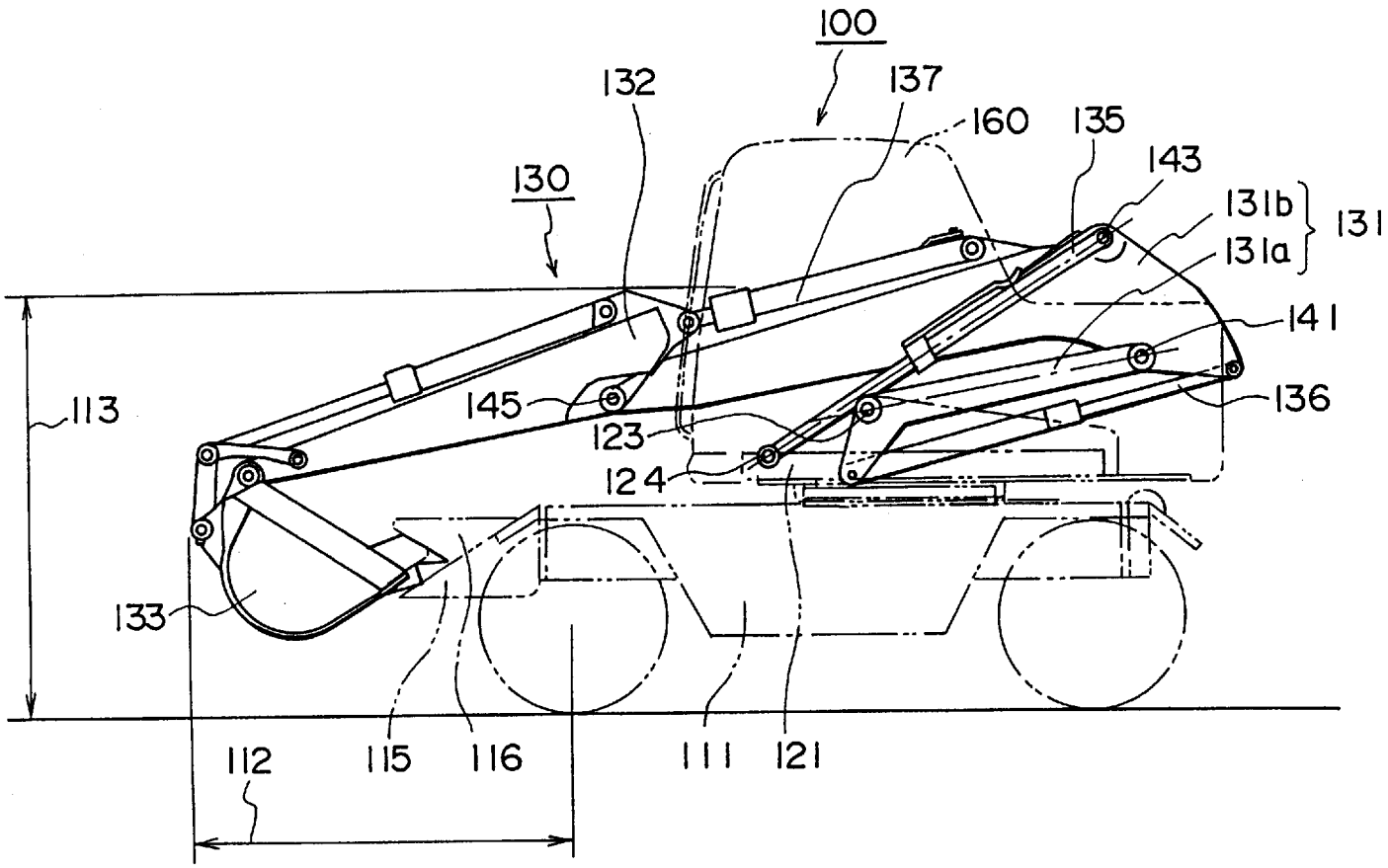
FIG. 4 CONVENTIONAL ART
FIG. 4 is a side view of a working unit of the working vehicle relating to the conventional art.
Figure 5:
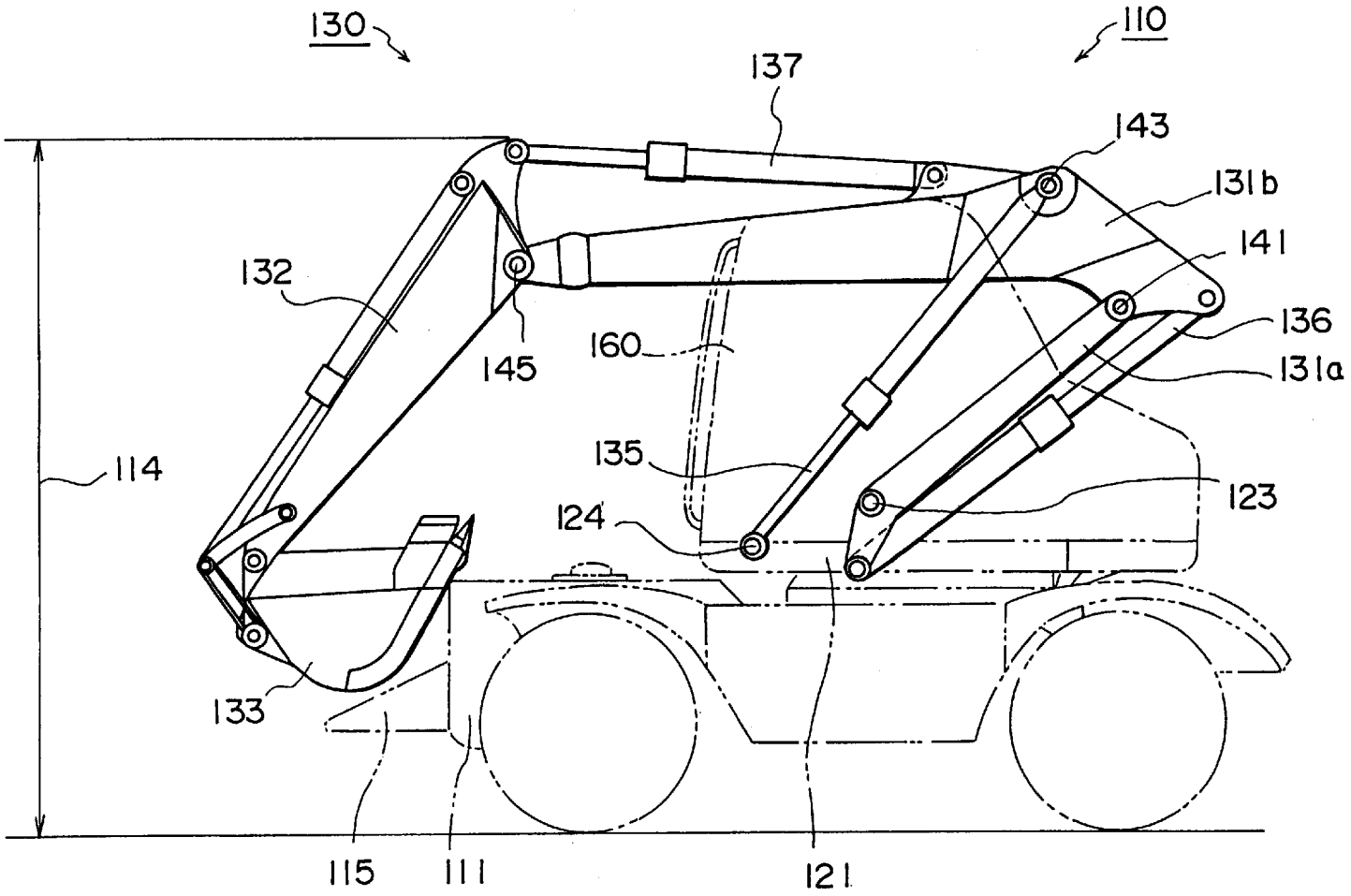
FIG. 5 CONVENTIONAL ART
FIG. 5 is a side view of the working unit in a traveling and transporting posture relating to the working vehicle of another conventional art.

Further, by removing a conventional hooking device 116 (FIG. 4, FIG. 5), the front overhang amount is decreased, so that excellent agility and cornering ability at a small working site can be obtained. Incidentally, in the storage posture, the first and second booms 31*a* and 31*b* and the arm 32 are substantially in a V-shaped form.

In an excavating condition in FIG. 2, as the arm hydraulic cylinder 38 is extended, the first arm link 33*a* is rotated in a counterclockwise direction with the tenth pivot pin 47 as its fulcrum. Since the first arm link 33*a* is connected to the arm 32 via the second arm link 33*b*, the arm 32 is rotated in a counterclockwise direction with the seventh pivot pin 45 as its fulcrum.

At the time of this rotation, the length of a line segment 46/47 (specifically, the distance between the pivot pins of the first arm link 33*a*) is greater than a line segment 45/48. On the other hand, in the conventional art, when explaining by using FIG. 2 of the present embodiment, the arm hydraulic cylinder 38 is directly connected to the eighth pivot pin 48 without utilizing the first and the second arm links 33*a* and 33*b*. Accordingly, by attaching the first arm link 33*a*, having the relatively great distance between its pivot pins, the angle of rotation of the arm 32 is increased even with the stroke of the arm hydraulic cylinder 38 being the same as in the conventional art. Since a radius of rotation moment M2 of the present embodiment is greater than the conventional M1, an excavating force F at the cutting edge of the bucket front end 34*a* is great and is obtained over a wide range of the angle of rotation of the arm 32.

Next, the visibility will be explained with reference to FIG. 1. As for the placement, the working unit 30 equipped with the bucket 32, etc., is attached on the right side portion of the rotary vehicle body frame 21, and the operator's cab 60 is attached on the left side portion of the vehicle body frame 21. On both side walls of the operator's cab, a lower side window 63, an upper side window 64, and a rear side window 65 are provided. Inside the operator's cab 60, an operation lever (not illustrated) for an actuating operation of the working unit 30 is mounted.

When the working unit 30 is in a storage posture, the position of the seventh pivot pin 45, connecting the second boom 31*b* to the arm 32, is on the vehicle body frame 21 and is lower than a line connecting an eye point 62 of the operator 61 and a front fender nose 21*a* of the vehicle body frame 21. Thereby, the operator 61 can see the right side of the working vehicle 1, which is the working unit 30 side, and the front lower part of the front fender nose 21*a* on the right side; and therefore the visibility is improved. Incidentally, in FIGS. 1 and 2, the operator's cab is closer than the working unit 30, and is illustrated by a phantom line in order to make understandable the configuration of the working unit 30, which is on the other side of the operator's cab 60.

INDUSTRIAL AVAILABILITY

The present invention is useful as a working vehicle having a great excavating force over a wide range with smooth operation of the working unit, whereby a visibility is excellent when the working unit is stored therein and an excellent transportability can be obtained.

We claim:

1. A working vehicle comprising:

a base carrier, said base carrier including a base frame having an upper surface;

an upper rotary body rotatably mounted on said base carrier;

a working unit attached to said upper rotary body;

an operator's cab mounted on said upper rotary body;

wherein said working unit includes a first boom, a second boom, an arm, and a bucket;

wherein a first end portion of said first boom is pivotally attached to said upper rotary body;

wherein a first end portion of said second boom is pivotally attached to a second end portion of said first boom;

wherein a first end portion of said arm is pivotally attached to a second end portion of said second boom;

wherein said bucket is attached to a second end portion of said arm;

wherein said first boom includes a boom storage section for storing said second boom inside said first boom; and wherein said working vehicle has a storage position for said first and second booms and said arm such that at a time of storage said first and second booms are positioned such that said second boom is stored in said boom storage section;

an arm hydraulic cylinder having first and second end portions, said first end portion of said arm hydraulic cylinder being pivotally attached to an intermediate portion of said second boom;

a first arm link having first and second end portions, said first end portion of said first arm link being pivotally attached to said second end portion of said second boom; and a second arm link having first and second end portions, said first end portion of said second arm link being pivotally attached to said first end portion of said arm; and wherein said second end portion of said first arm link is pivotally attached to said second end portion of said second arm link and to said second end portion of said arm hydraulic cylinder.

2. A working vehicle in accordance with claim 1, wherein in said storage position said arm is positioned substantially parallel to said upper surface of said base frame of said base carrier with said arm hydraulic cylinder in a contracted state.

3. A working vehicle in accordance with claim 2, wherein in said storage position, said second boom and said arm are in a substantially V-shaped configuration.

4. A working vehicle comprising:

a base carrier, said base carrier including a base frame having an upper surface;

an upper rotary body rotatably mounted on said base carrier;

a working unit attached to said upper rotary body;

an operator's cab mounted on said upper rotary body;

wherein said working unit includes a first boom, a second boom, an arm, and a bucket;

wherein said first boom has first and second end portions which are separated from each other by an intermediate portion, with said first end portion of said first boom being pivotally attached to said upper rotary body so that said first boom can swing with respect to said upper rotary body;

wherein said second boom has first and second end portions which are separated from each other by an intermediate portion, with the intermediate portion of said second boom being pivotally attached to the second end portion of said first boom so that said second boom can swing with respect to said first boom;

wherein said arm has first and second end portions separated from each other by an intermediate portion, with the intermediate portion of said arm being pivotally attached to the second end portion of said second boom so that said arm can swing with respect to said second boom;

wherein said bucket is attached to a second end portion of said arm so that said bucket can swing with respect to said arm;

a first hydraulic cylinder having first and second end portions, said first end portion of said first hydraulic cylinder being pivotally attached to said upper rotary body, said second end portion of said first hydraulic cylinder being pivotally attached to a portion of said second boom which is located between (a) a position at which said second boom is pivotally attached to said first boom and (b) a position at which said arm is attached to said second boom;

a second hydraulic cylinder having first and second end portions, said first end portion of said second hydraulic cylinder being pivotally attached to said first boom, said second end portion of said second hydraulic cylinder being pivotally attached to the first end portion of said second boom;

a first arm link having first and second end portions, said first end portion of said first arm link being attached to said second boom at a location between (a) a position at which the second end portion of said first hydraulic cylinder is pivotally attached to said second boom and (b) a position at which said intermediate portion of said arm is connected to the second end portion of said second boom;

a second arm link having first and second end portions, said first end portion of said second arm link being attached to said first end portion of said arm; and a third hydraulic cylinder having first and second end portions, said first end portion of said third hydraulic cylinder being pivotally attached to said second boom, said second end portion of said third hydraulic cylinder being pivotally attached to the second end portion of said first arm link and to the second end portion of said second arm link.

5. A working vehicle in accordance with claim 4, wherein the first end portion of the first arm link is pivotally attached to said second boom in the vicinity of the position in which the intermediate portion of said arm is attached to the second end portion of said second boom.

6. A working vehicle in accordance with claim 4, further comprising:

a first bucket link having first and second end portions, said first end portion of said first bucket link being pivotally attached to said arm at a location between (a) a position at which said second end portion of said second boom is attached to said arm and (b) a position at which said bucket is attached to said arm;

a second bucket link having first and second end portions, said first end portion of said second bucket link being pivotally attached to said bucket; and a fourth hydraulic cylinder having first and second end portions, said first end portion of said fourth hydraulic cylinder being pivotally attached to said arm, said second end portion of said fourth hydraulic cylinder being pivotally attached to the second end portion of said first bucket link and to the second end portion of said second bucket link.

7. A working vehicle in accordance with claim 6, wherein the first end portion of the first arm link is pivotally attached to said second boom in the vicinity of the position in which the intermediate portion of said arm is attached to the second end portion of said second boom.

8. A working vehicle in accordance with claim 7, wherein the first end portion of said fourth hydraulic cylinder is attached to said arm in the vicinity of the first end portion of said arm such that a length between (a) a point of attachment of the first end portion of said first arm link to said second boom and (b) a point of attachment of the second end portion of said first arm link to the second end portion of said third hydraulic cylinder is greater than a length between (c) a point of attachment of said intermediate portion of said arm to said second boom and (d) a point of attachment of the first end portion of said second arm link to said arm.

9. A working vehicle in accordance with claim 8, wherein the first end portion of the first bucket link is connected to said arm in the vicinity of said second end portion of said arm.

10. A working vehicle in accordance with claim 9, wherein said first boom includes a boom storage section for storing said second boom inside said first boom; and wherein said working vehicle has a storage position for said first and second booms and said arm such that at a time of storage said first and second booms are positioned such that said second boom is stored in said boom storage section.

11. A working vehicle in accordance with claim 10, wherein in said storage position said arm is positioned substantially parallel to an upper surface of said base carrier with said third hydraulic cylinder in a contracted state.

12. A working vehicle in accordance with claim 11, wherein in said storage position, said second boom and said arm are in a substantially V-shaped configuration.

13. A working vehicle in accordance with claim 7, wherein the first end portion of the first bucket link is connected to said arm in the vicinity of said second end portion of said arm.

14. A working vehicle in accordance with claim 4, wherein said first end portion of said third hydraulic cylinder is pivotally attached to the intermediate portion of said second boom.

15. A working vehicle in accordance with claim 4, wherein said second end portion of said first hydraulic cylinder and said first end portion of said third hydraulic cylinder are attached to said second boom by a common pivot pin.

16. A working vehicle in accordance with claim 15, wherein the first end portion of the first arm link is pivotally attached to said second boom in the vicinity of the position in which the intermediate portion of said arm is attached to the second end portion of said second boom.

17. A working vehicle in accordance with claim 4, wherein said first boom includes a boom storage section for storing said second boom inside said first boom; and wherein said working vehicle has a storage position for said first and second booms and said arm such that at a time of storage said first and second booms are positioned such that said second boom is stored in said boom storage section.

18. A working vehicle in accordance with claim 17, wherein in said storage position said arm is positioned substantially parallel to an upper surface of said base carrier with said third hydraulic cylinder in a contracted state.

19. A working vehicle in accordance with claim 17, wherein in said storage position, said arm extends forwardly generally horizontally from the second end portion of said second boom, and said second boom and said arm are in a substantially V-shaped configuration.

* * * * *